US005452835A

United States Patent [19]

Shkolnikov

[11] Patent Number: 5,452,835

[45] Date of Patent: Sep. 26, 1995

[54] POSITIONING MECHANISM FOR POWERED FASTENER-DRIVING TOOL

[75] Inventor: Yury Shkolnikov, Glenview, Ill.

[73] Assignee: Illinois Tool Works Inc., Glenview, Ill.

[21] Appl. No.: 415,089

[22] Filed: Mar. 31, 1995

Related U.S. Application Data

[63] Continuation of Ser. No. 283,580, Aug. 1, 1994, abandoned.

[51] Int. Cl.[6] ..... B25C 7/00

[52] U.S. Cl. ..... 227/8; 227/32; 227/110; 227/119

[58] Field of Search ..... 227/8, 31, 32, 227/60, 110, 119, 107, 139

[56] References Cited

U.S. PATENT DOCUMENTS

| | | | |
|---|---|---|---|
| 3,670,941 | 6/1972 | Grinnell et al. | 227/8 |
| 3,820,705 | 6/1974 | Beals | 227/110 |
| 4,195,762 | 4/1980 | Burton | 227/156 |
| 4,339,065 | 7/1982 | Haytayan | 227/32 |
| 4,424,929 | 1/1984 | Weis | 227/32 |
| 4,579,270 | 4/1986 | Matsuda | 227/31 |
| 4,928,867 | 5/1990 | Jensen | 227/7 |
| 4,932,480 | 6/1990 | Golsch | 173/139 |
| 5,052,607 | 10/1991 | Dutton | 227/107 |
| 5,238,167 | 8/1993 | Howard et al. | 227/110 |

FOREIGN PATENT DOCUMENTS

| | | |
|---|---|---|
| 38396 | 4/1980 | European Pat. Off. . |
| 1402034 | 8/1975 | United Kingdom . |

*Primary Examiner*—Scott A. Smith
*Attorney, Agent, or Firm*—Dressler, Goldsmith, Shore & Milnamow, Ltd.

[57] ABSTRACT

In a powered fastener-driving tool including a nosepiece arranged to guide a fastener driven by the tool and an actuator movable between an extended position and a retracted position and biased toward the extended position for disabling the tool unless the actuator is moved toward the retracted position, an improved mechanism is disclosed for positioning the tool relative to an opening in a workpiece to be fastened to a substrate. The mechanism comprises a probe having a tapered end adapted to extend into the opening of the workpiece for aligning the nosepiece with respect to the opening of the workpiece so that a fastener can be precisely driven through the opening of the workpiece. The mechanism further comprises a pivot pin for mounting the probe pivotally to the actuator via an arm mounted fixedly to the actuator and a bracket mounted fixedly to the arm. Thus, the probe is mounted so as to provide for conjoint movement of the probe with the actuator between the extended and retracted positions and so as to permit pivotal movement of the probe relative to the actuator, over a limited range of pivotal movement, between a fastener-engaging position wherein the probe is engageable by a driven fastener and a pivotally displaced position wherein the probe is displaced pivotally from the fastener-engaging position so as to permit a driven fastener to be driven past the probe.

8 Claims, 3 Drawing Sheets

POSITIONING MECHANISM FOR POWERED FASTENER-DRIVING TOOL

This is a continuation of application Ser. No. 08/283,580, filed Aug. 1, 1994, now abandoned.

TECHNICAL FIELD OF THE INVENTION

This invention pertains to an improved mechanism for positioning the nosepiece of a powered fastener-driving tool so that a fastener can be precisely driven through an opening in a workpiece to be fastened to a substrate. The mechanism comprises a pivotally mounted probe having a fastener-engaging position and a pivotally displaced position.

BACKGROUND OF THE INVENTION

Commonly, a pneumatically powered or combustion-powered fastener-driving tool is used for driving a fastener, such as a nail, through an opening in a workpiece, such as a metal channel, into a substrate adjacent to the workpiece. Typically, such a tool has a nosepiece, which is arranged to guide a driven fastener. Because such a tool tends to obscure the opening, it can be very difficult to align the nosepiece so that a fastener can be precisely driven through the opening.

Positioning or pointing mechanisms are known for aligning the nosepiece of a pneumatically powered or combustion-powered fastener-driving tool relative to an opening in a workpiece. A positioning mechanism of particular interest is disclosed in Howard et al. U.S. Pat. No. 5,238,167. A positioning mechanism of related interest is disclosed in Dutton U.S. Pat. No. 5,052,607.

The positioning mechanism illustrated and described in Howard et al. U.S. Pat. No. 5,238,167 is employed in a powered fastener-driving tool and comprises a probe having a tapered end connected to an actuator, via a spring strip, so as to be laterally movable. As a fastener is driven and the tool recoils, the probe is engaged by the driven fastener, so as to be moved laterally and from the opening.

SUMMARY OF THE INVENTION

This invention provides, in a powered fastener-driving tool including a nosepiece arranged to guide a fastener driven by the tool, an improved mechanism for positioning the tool relative to an opening defined within a workpiece to be fastened to a substrate. The improved mechanism comprises means including a probe, which is connected to the nosepiece and which is adapted to extend into the opening of the workpiece, for aligning the nosepiece with respect to the opening of the workpiece so that a fastener can be precisely driven through the opening of the workpiece. Preferably, the probe has a tapered end, which is adapted to extend into the opening of the workpiece.

The improved mechanism differs from the positioning mechanism illustrated and described in Howard U.S. Pat. No. 5,238,167 in that the improved mechanism further comprises means including a pivot pin for mounting the probe pivotally to the actuator. Thus, the pivot pin mounts the probe so as to provide for conjoint movement of the probe with the actuator between the extended and retracted positions. Also, the pivot pin mounts the probe so as to permit pivotal movement of the probe relative to the actuator, over a limited range of pivotal movement, between a fastener-engaging position wherein the probe is engageable by a driven fastener and a pivotally displaced position wherein the probe is displaced pivotally from the fastener-engaging position so as to permit a driven fastener to be driven past the probe.

In one contemplated arrangement, in which the powered fastener-driving tool includes a nosepiece arranged to guide a fastener driven by the tool and further includes means including an actuator movable between an extended position and a retracted position and biased toward the extended position for disabling the tool unless the actuator is moved toward the retracted position, the pivot pin is used for mounting the probe pivotally to the actuator.

In the aforementioned arrangement, the pivot pin provides for conjoint movement of the probe with the actuator between the extended and retracted positions. Furthermore, the pivot pin permits pivotal movement of the probe relative to the actuator, over a limited range of pivotal movement, between a fastener-engaging position wherein the probe is engageable by a driven fastener and a pivotally displaced position wherein the probe is displaced pivotally from the fastener-engaging position.

Preferably, a distance between an axis defined by the pivot pin and a bottom portion of the probe defines a moment arm, which utilizes force imparted on the actuator when the actuator is moved from the extended position for pivoting the probe to the fastener-retaining position and for retaining the probe in the fastener-engaging position.

Preferably, the mounting means includes a bracket mounted fixedly to the actuator for conjoint movement with the actuator between the extended and retracted positions, and the probe is mounted pivotally to the bracket. Preferably, the mounting means further includes an arm mounted fixedly to the actuator for conjoint movement with the actuator between the extended and retracted positions, and the bracket is mounted fixedly to the arm. Preferably, moreover, the probe has portions adapted to engage portions of the arm so as to limit pivotal movement of the probe respectively to the fastener-engaging and pivotally displaced positions.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
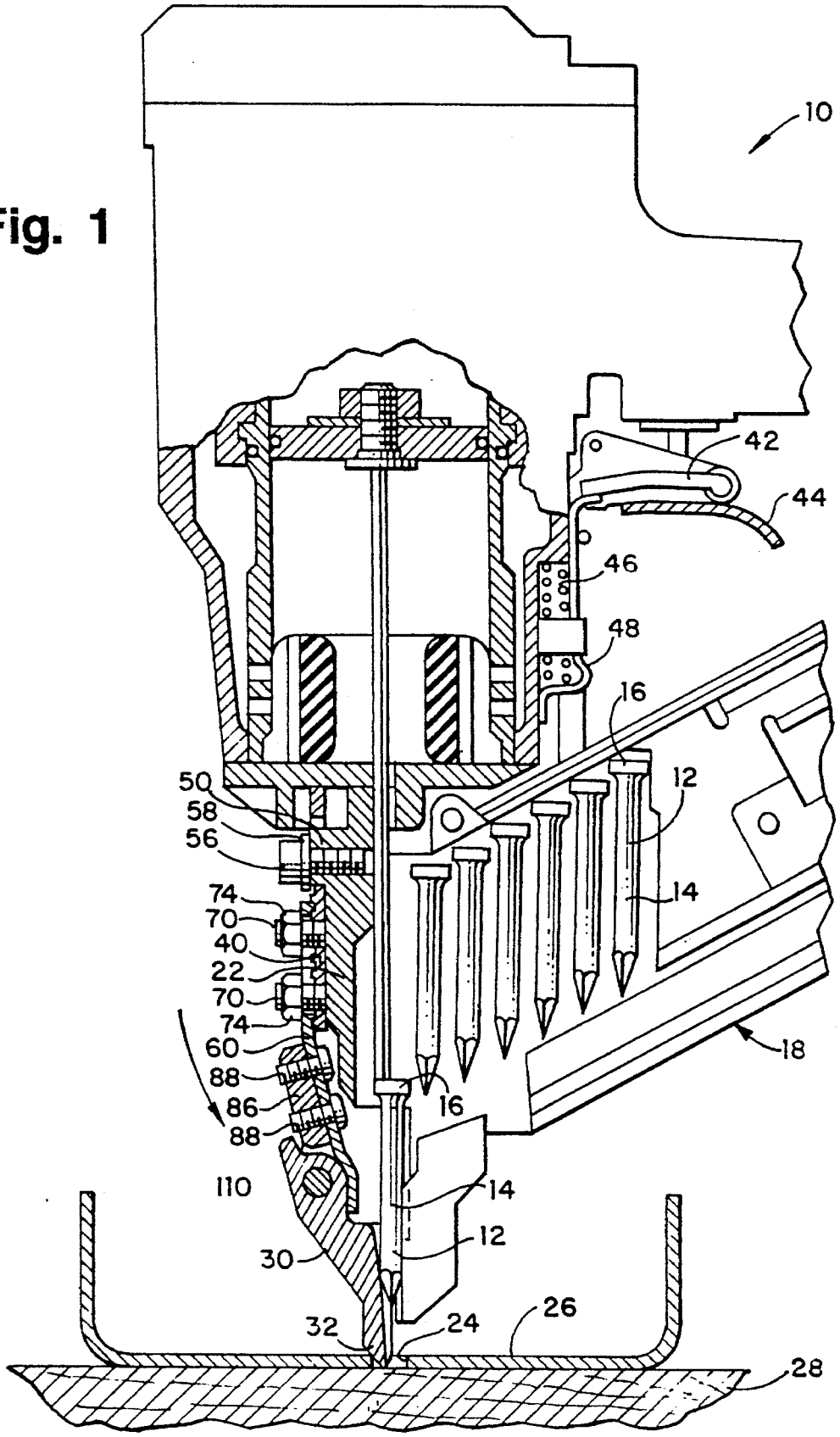
FIG. 1 is a fragmentary, cross-sectional view of a pneumatically powered fastener-driving tool incorporating a positioning mechanism according to a preferred embodiment of this invention.

As shown in FIG. 1, a pneumatically powered fastener-driving tool 10 for driving fasteners exemplified by wire nails 12 having pointed shanks 14 and enlarged heads 16, as fed from a magazine 18 of the tool, comprises a mechanism 20 according to a preferred embodiment of this invention for positioning a nosepiece 22 of the tool 10 so that a nail 12 can be precisely driven by the tool 10, through a circular opening 24 of a workpiece 26, into a substrate 28 adjacent to the workpiece 26. As shown, the workpiece 26 is a metal channel, and the substrate 28 is a wooden beam.

The positioning mechanism 20 comprises means including a probe 30, which is connected to the nosepiece 22 and which is adapted to extend into the opening 24 of the workpiece 26, for aligning the nosepiece 22 with respect to the opening 24 so that a nail 12 can be precisely driven through the opening 24. As shown, the probe 30 has a tapered end 32, which is to extend into the opening 24.

Except as illustrated and described, the tool 10 is similar to pneumatically powered fastener-driving tools known heretofore, as exemplified in Golsch U.S. Pat. No. 4,932,480, the disclosure of which is incorporated herein by reference. Such pneumatically powered fastener-driving tools are available commercially from ITW Paslode (a unit of Illinois Tool Works Inc.) of Lincolnshire, Ill., under its PASLODE trademark.

Thus, the tool 10 has an actuator 40 mounted operatively to the nosepiece 22 and linked operatively to a lever 42, which is mounted pivotally to a trigger 44. The actuator 40 is movable upwardly and downwardly over a limited range of actuator movement, between an extended position and a retracted, and is biased downwardly by a spring 46 via a member 48 linked to the actuator 40. The actuator 40, lever 42, trigger 44, spring 46, and member 48 and certain valves and other elements of the tool 10 are arranged, in a well known manner, as a mechanism for disabling the tool 10 unless the actuator 40 is moved upwardly so as to lift the lever 42.

To define the limited range of actuator movement, the actuator 40 has an elongate slot 50, through which a boss 52 on the nosepiece 22 extends. A machine screw 54 is threaded into a threaded socket in the boss 52. A washer 56 is interposed between the head 58 of the machine screw 54 and the boss 52. The machine screw 54 and the washer 56 retain the actuator 40 on the tool 10.

In such a tool, as known heretofore, such an actuator is adapted to be pressed firmly against a workpiece to move the actuator upwardly so as to lift such a lever. In the tool 10, however, the probe 30 is connected to the actuator 40 so as to be conjointly movable with the actuator 40, and so as to be pivotally movable, and is adapted to be pressed firmly against the workpiece 26 to move the actuator 40 upwardly so as to lift the lever 42.

Directional terms including "upwardly" and "downwardly" are used herein with reference to the tool 10 in its usual orientation, in which it is shown, but are not intended to limit this invention to any given orientation of the tool 10.

The positioning mechanism 20 comprises a bent arm 60 having a proximal portion 62, an intermediate portion 64, and a distal portion 66. The bent arm is mounted fixedly but adjustably to the actuator 40, near the proximal end 62, via two threaded studs 70. The threaded studs 70 pass through an elongate slot 72 in the intermediate portion 64 and receive threaded nuts 74. Ribs and grooves are formed on an inner surface 76 of the proximal portion 62 and on a facing surface 78 of the actuator 40 so as to facilitate precise adjustment of the bent arm 60 relative to the actuator 40.

The positioning mechanism 20 further comprises a bracket 80 having two tubular portions 82, which define an axis and have axially aligned, circular openings 84, and a mounting portion 86, which extends from the tubular portions 82. The bracket 80 is mounted fixedly to the bent arm 60 via two machine screws 88, each having an enlarged head 90, passing through one of two unthreaded openings 92 in the bent arm 60 and being threaded into an aligned one of two threaded openings 94 in the mounting portion 86 of the bracket 80.

The probe 30 has a shoulder 100, which is fitted loosely between the tubular portions 82 of the bracket 80, and which has a circular opening 102 aligned axially with the circular openings 84 of the tubular portions 82. A pivot pin 110 having an enlarged head 112 passes through the circular opening 84 of one such tubular portion 82, through the circular opening 102 of the shoulder 100, and through the circular opening 84 of the other tubular portion 82. A retaining clip 114 fits around the pivot pin 110, at a circumferential groove 116 beyond the latter tubular portion 82, so as to retain the probe 30.

The probe 30 is mounted pivotally to the bracket 80, via the pivot pin 110 and associated elements described above, so as to have a limited range of pivotal movement (e.g., a range of about 4°, as indicated on FIG. 3) relative to the bracket 80, the bent arm 60, and the actuator 40. The distal portion 66 of the bent arm 60 is wider than the probe 30 and has a large notch 118 opening downwardly. A distance between an axis defined by the pivot pin 110 and the tapered end 32 of the probe 30 defines a moment arm, which utilizes force imparted on the actuator 40 when the actuator 40 is moved from the extended position for pivoting the probe 30 to the fastener-engaging position and for retaining the probe 30 in the fastener-engaging position.

Figure 4:
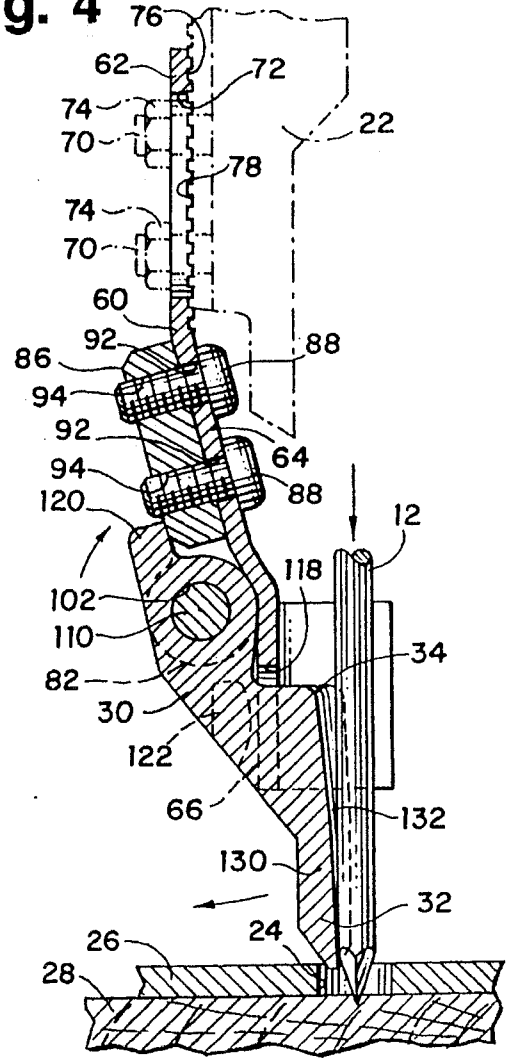
FIGS. 3 and 4, on a similar scale, are fragmentary, cross-sectional details of the positioning mechanism shown in FIGS. 1 and 2, at different stages of tool operation.
Figure 3:
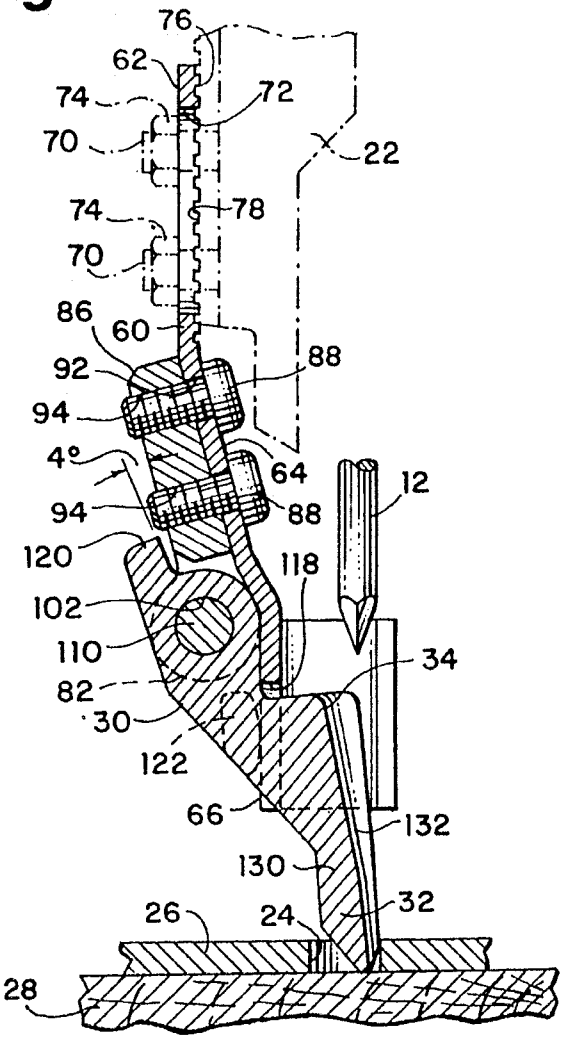
Figure 2:
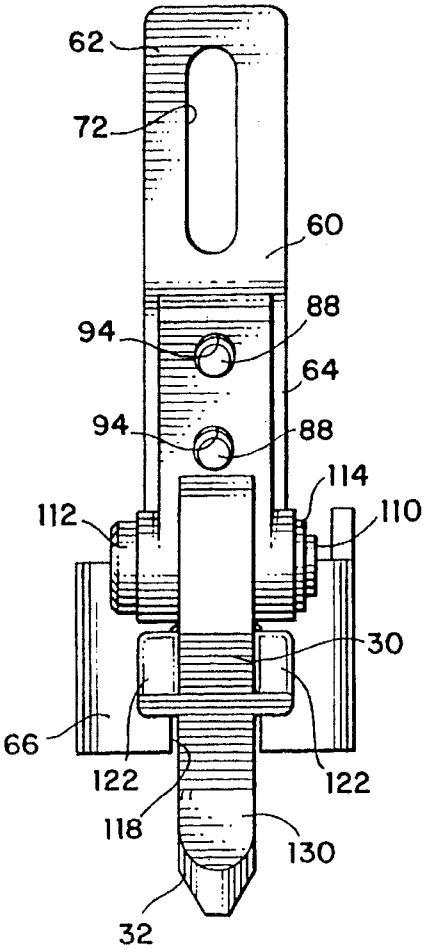
FIG. 2, on a larger scale, is an elevational detail of the positioning mechanism shown in FIG. 1.
Figure 5:
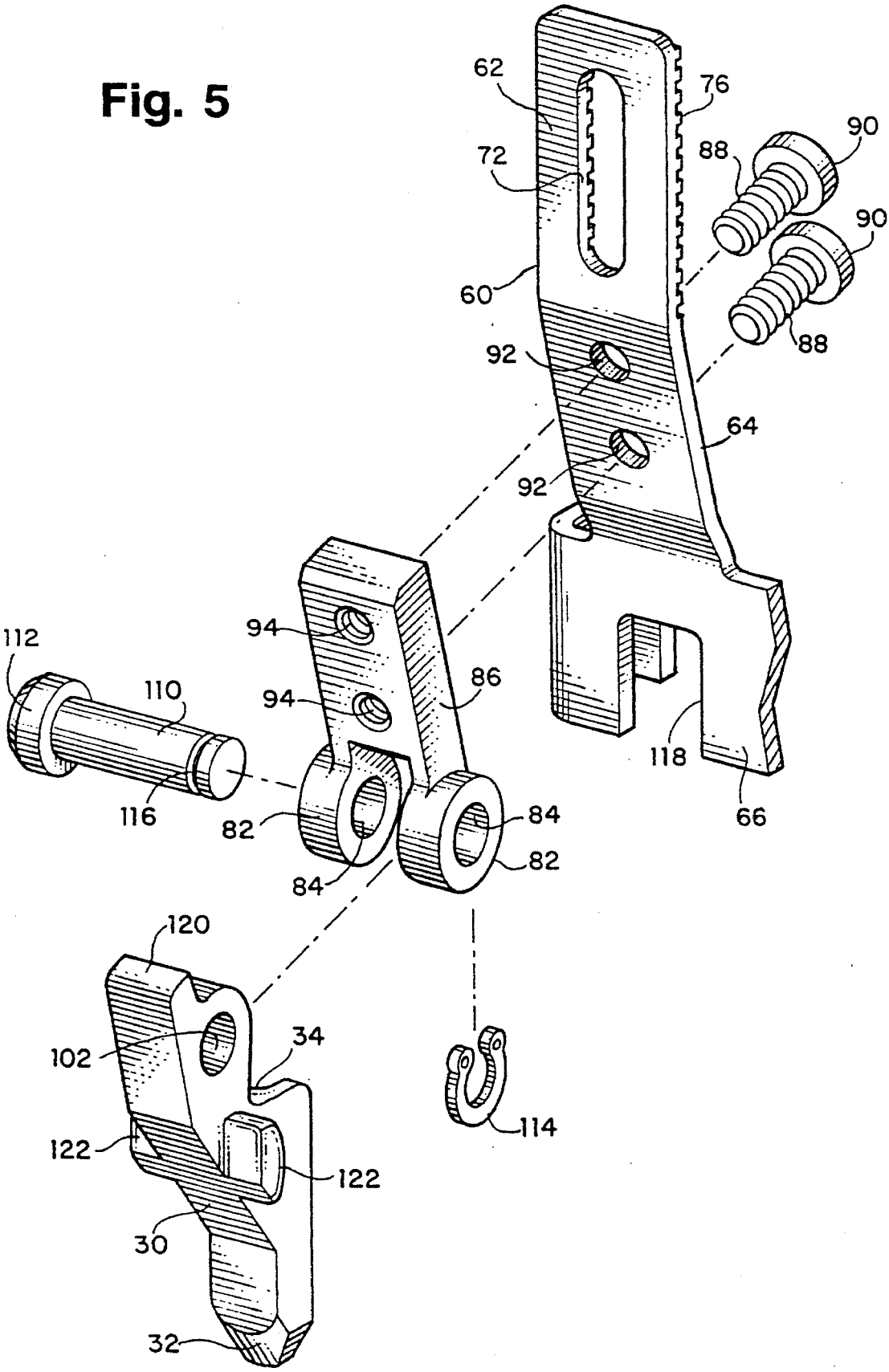
FIG. 5 is an exploded view of elements of the positioning mechanism.

The probe 30 has an upper, upwardly extending portion 120, which is adapted to engage the mounting portion 86 of the bracket 80, as shown in FIG. 3, so as to limit pivotal movement of the probe 30 in one pivotal direction relative to the bent arm 60. The probe 30 has two lower, laterally extending portions 122, which are adapted to engage the mounting portion 86 of the bracket 80 on opposite sides of the large notch 118, as shown in FIG. 4, so as to limit pivotal movement of the probe 30 in the opposite direction relative to the bracket 80. Thus, pivotal movement of the probe 30 relative to the bracket 80, the bent arm 60, and the actuator 40 is limited when the probe 30 is pivoted to a fastener-engaging position wherein the probe 30 is engageable by a nail 12 being driven.

The probe 30 has a lower, fastener-engaging portion 130, which extends loosely through the large notch 118 in the distal portion 66 of the bent arm 60, over the limited range of pivotal movement of the probe 30 relative to the bracket 80, the bent arm 60, and the actuator 40. Thus, pivotal movement of the probe 30 relative to the bracket 80, the bent arm 60, and the actuator 40 is limited when the probe 30 is pivoted to a pivotally displaced position wherein the probe 30 is displaced from the fastener-engaging position so as to permit a nail 12 to be driven past the probe 30.

The fastener-engaging portion 130 has a groove 132 facing laterally and merging with the rounded surface 34 of the probe 30. The tapered end 132 is formed on the fastener-engaging portion 130. As mentioned above, the opening 24 is circular. Preferably, the tapered end 32 of the probe 30 is shaped as one half of a frustum of a cone to guide the end 32 into the opening 24 and to fill approximately one half of the opening 24 when the end is pressed firmly against the workpiece 26, at the margin of the opening 24. When a nail is driven by the tool 10, the shank 14 of the driven nail 12 is driven along the groove 132 until the head 16 of the driven nail 12 engages the rounded surface 34, whereupon the driven nail 12 pivots the probe 30 from the opening as the tool 10 recoils. The tapered end 32 can act as a camming surface, which can operate against the margin of the opening 24, as the tool 10 recoils.

Although the positioning mechanism 20 is shown as used in a pneumatically powered fastener-driving tool 10, this invention can be used alternatively in combustion-powered tools (not shown) of a type exemplified in Nikolich U.S. Pat. Nos. Re. 32,452, 4,403,722, 4,483,474, and 4,522,162, the disclosures of which are incorporated herein by reference. Such combustion-powered fastener-driving tools are available commercially from ITW Paslode, supra, under its IMPULSE trademark. Such combustion-powered tools comprise mechanisms for disabling such tools unless actuators analogous to the actuator 40 and biased analogously are moved from extended position into retracted positions so as to close combustion chambers of such tools.

Various modifications may be made in the preferred embodiment described above without departing from the scope and spirit of this invention.

I claim:

1. In a powered fastener-driving tool including a nosepiece arranged to guide a fastener driven by said tool, a mechanism for positioning the tool relative to an opening defined within a workpiece to be fastened to a substrate, the mechanism comprising (a) means including a probe connected to the nosepiece and adapted to extend into the opening of the workpiece for aligning the nosepiece with respect to the opening of the workpiece so that a fastener can be precisely driven through the opening of the workpiece and (b) means including a pivot pin for mounting the probe so as to permit pivotal movement of the probe, over a limited range of pivotal movement, between a fastener-engaging position wherein the probe is engageable by a driven fastener and a pivotally displaced position wherein the probe is displaced pivotally from the fastener-engaging position.

2. The mechanism of claim 1 wherein the probe has a tapered end adapted to extend into the opening of the workpiece.

3. In a powered fastener-driving tool including a nosepiece arranged to guide a fastener driven by the tool and means including an actuator movable between an extended position and a retracted position and biased toward the extended position for disabling the tool unless the actuator is moved toward the retracted position, a mechanism for positioning the tool relative to an opening defined within a workpiece to be fastened to a substrate, the mechanism comprising (a) means including a probe adapted to extend into the opening of the workpiece for aligning the nosepiece with respect to the opening of the workpiece so that a fastener can be precisely driven through the opening of the workpiece and (b) means including a pivot pin for mounting the probe pivotally to the actuator so as to provide for conjoint movement of the probe with the actuator between the extended and retracted positions and so as to permit pivotal movement of the probe relative to the actuator, over a limited range of pivotal movement, between a fastener-engaging position wherein the probe is engageable by a driven fastener and a pivotally displaced position wherein the probe is displaced pivotally from the fastener-engaging position so as to permit a driven fastener to be driven past the probe.

4. The mechanism of claim 3 wherein the mounting means includes a bracket, which is mounted fixedly to the actuator for conjoint movement with the actuator between the extended and retracted positions, the probe being mounted pivotally to the bracket.

5. The mechanism of claim 4 wherein the mounting means further includes an arm, which is mounted fixedly to the actuator for conjoint movement with the actuator between the extended and retracted positions, the bracket being mounted fixedly to the arm.

6. The mechanism of claim 5 wherein the probe has portions adapted to engage portions of the arm so as to limit pivotal movement of the probe respectively to the fastener-engaging and pivotally displaced positions.

7. The mechanism of claim 5 wherein the probe has a tapered end adapted to extend into the opening of the workpiece.

8. The mechanism of claim 3 wherein the pivot pin defines an axis, and wherein a distance between said axis and a bottom portion of the probe defines a moment arm, which utilizes force imparted on the actuator when the actuator is moved from the extended position for pivoting the probe to the fastener-engaging position and for and retaining the probe in the fastener-engaging position.

* * * * *

UNITED STATES PATENT AND TRADEMARK OFFICE

CERTIFICATE OF CORRECTION

PATENT NO. : 5,452,835

DATED : September 26, 1995

INVENTOR(S) : Yury Shkolnikov

It is certified that error appears in the above-indentified patent and that said Letters Patent is hereby corrected as shown below:

Column 3, line 9, after "is", --adapted-- should be inserted.

Column 3, line 23, after "retracted", --position-- should be inserted.

Signed and Sealed this

Fifth Day of November, 1996

*Attest:*

*Attesting Officer*

Bruce Lehman

BRUCE LEHMAN

*Commissioner of Patents and Trademarks*